US008166584B2

(12) United States Patent
Ball

(10) Patent No.: US 8,166,584 B2
(45) **Date of Patent: *May 1, 2012**

(54) OVERFLOW ASSEMBLY FOR BATHTUBS AND THE LIKE

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 1042 days.

This patent is subject to a terminal disclaimer.

(21) Appl. No.: 12/057,660

(22) Filed: Mar. 28, 2008

(65) Prior Publication Data

US 2008/0235866 A1 Oct. 2, 2008

Related U.S. Application Data

(63) Continuation-in-part of application No. 10/674,862, filed on Sep. 30, 2003, now abandoned, which is a continuation-in-part of application No. 10/222,062, filed on Aug. 16, 2002, now Pat. No. 6,637,050, and a continuation-in-part of application No. 10/229,533, filed on Aug. 28, 2002, now Pat. No. 6,675,406, which is a continuation of application No. 09/593,724, filed on Jun. 13, 2000, now abandoned, application No. 12/057,660, which is a continuation-in-part of application No. 10/732,726, filed on Dec. 10, 2003, said application No. 10/732,726 is a continuation-in-part of application No. 09/954,420, filed on Sep. 17, 2001, now Pat. No. 6,691,411.

(51) Int. Cl.
*E03C 1/22* (2006.01)
*E03C 1/24* (2006.01)

(52) U.S. Cl. ..... 4/680

(58) Field of Classification Search ..... 4/680, 651, 4/679, 683, 684, 685, 694; 411/431; 285/3; 138/89–90; 73/49.1
See application file for complete search history.

(56) References Cited

U.S. PATENT DOCUMENTS 427,478 A 5/1890 McEvoy (Continued)

FOREIGN PATENT DOCUMENTS

| | | |
|---|---|---|
| CH | 346187 | 4/1960 |
| DE | 1163257 | 2/1964 |
| FR | 744099 | 4/1933 |

OTHER PUBLICATIONS

Official Action for U.S. Appl. No. 10/732,726, mailed Sep. 4, 2009.

(Continued)

*Primary Examiner* — Lori Baker
(74) *Attorney, Agent, or Firm* — Sheridan Ross P.C.

(57) ABSTRACT

An overflow system in the bathtub has an overflow port and has a drain pipe in connection with the overflow port. A threaded flange has a stub shoulder on one end which is fitted into a circular sleeve on the overflow port. The threaded flange has exterior threads on its outer surface and a thin diaphragm secured to the end thereof opposite to the stub shoulder. A large sealing washer embraces the outside of the circular flange on the overflow port and extends partially over the threads of the threaded flange. A large internally threaded nut is threadably mounted on the outer end of the threaded flange and compresses the sealing washer against a vertical flange on the port to seal the connection between the threaded flange and the port. A decorative cap is frictionally snapped into engagement with protrusions on the outer surface of the nut. The cap can be removed when needed to permit the plumber to gain access to the diaphragm to cut it open for fluid flow after the system has been tested for leaks, or put in place after the cut takes place.

10 Claims, 11 Drawing Sheets

U.S. PATENT DOCUMENTS 843,968 A 2/1907 Sharp, Jr.
1,213,466 A 1/1917 Delanoy et al.
1,330,909 A 2/1920 Sharp, Jr.
1,518,599 A 12/1924 Murray
1,788,083 A 1/1931 Church
1,925,008 A 8/1933 Schacht
1,977,177 A 10/1934 De Flores
2,044,253 A 6/1936 Morris
2,062,145 A 11/1936 Pickop
2,223,365 A 12/1940 Groeniger
2,374,815 A 5/1945 Haas, Jr.
2,444,340 A 6/1948 Donahue
2,832,081 A 4/1958 Young
2,915,903 A 12/1959 Digby et al.
2,993,655 A 7/1961 O'Brien
3,121,879 A 2/1964 Young
3,493,978 A 2/1970 Hindman et al.
3,937,497 A 2/1976 Studer
D248,133 S 6/1978 Shames et al.
4,135,258 A 1/1979 Braga et al.
4,146,939 A 4/1979 Izzi
4,233,697 A 11/1980 Cornwall
4,307,901 A 12/1981 Orberg et al.
4,352,213 A 10/1982 Watts
4,359,790 A 11/1982 Chalberg
4,387,914 A 6/1983 Paulson et al.
4,413,384 A 11/1983 Lassche
4,553,625 A 11/1985 Tsuge et al.
4,683,597 A 8/1987 Taylor et al.
4,730,855 A 3/1988 Pelletier
D296,816 S 7/1988 Budzinski et al.
4,813,745 A 3/1989 Woody
4,825,477 A 5/1989 Aranda
4,865,353 A 9/1989 Osborne
4,890,967 A 1/1990 Rosenbaum
4,920,582 A 5/1990 Alker
4,953,235 A 9/1990 Cornwall
5,025,509 A 6/1991 Holt et al.
5,257,648 A 11/1993 Oropallo
5,267,474 A 12/1993 Ten Hoven
5,273,077 A 12/1993 Oropallo
5,350,266 A * 9/1994 Espey et al. ..... 411/431
5,351,996 A 10/1994 Martin
5,377,361 A 1/1995 Piskula
5,507,501 A 4/1996 Palmer
5,590,916 A 1/1997 Liu
5,692,248 A 12/1997 Ball
5,745,931 A 5/1998 Ball
5,786,054 A 7/1998 Platusich et al.
5,799,986 A 9/1998 Corbett et al.
5,815,895 A 10/1998 Carlson et al.
5,890,241 A 4/1999 Ball
5,957,514 A 9/1999 Brookshire
5,971,438 A 10/1999 Johnson
6,058,526 A 5/2000 Parisi et al.
6,073,278 A 6/2000 Ball
D428,133 S 7/2000 Chen
6,085,363 A 7/2000 Huber
6,088,843 A 7/2000 Francisco
6,126,233 A 10/2000 Gaetano et al.
6,145,136 A 11/2000 Parisi et al.
6,192,531 B1 2/2001 Fritz et al.
6,193,879 B1 2/2001 Bowman
6,216,288 B1 * 4/2001 Bernau ..... 4/694
6,263,518 B1 7/2001 Magtanong
6,289,532 B1 9/2001 Fritz et al.
6,295,664 B2 * 10/2001 Fritz et al. ..... 4/679
6,338,168 B1 1/2002 Valentine
6,362,734 B1 3/2002 McQuade et al.
6,448,907 B1 9/2002 Naclerio
6,484,331 B2 11/2002 Minnick
6,530,722 B1 3/2003 Shaw et al.
6,546,573 B1 4/2003 Ball
6,606,753 B2 8/2003 Minnick
6,618,875 B1 9/2003 Oropallo et al.
6,637,050 B1 * 10/2003 Ball ..... 4/680
6,675,406 B2 * 1/2004 Ball ..... 4/683
6,691,411 B2 * 2/2004 Ball ..... 29/890.141
6,696,943 B1 2/2004 Elrod et al.
6,812,844 B1 11/2004 Burgess
6,836,911 B2 1/2005 Minnick
6,953,049 B2 10/2005 Kowalke
D517,666 S 3/2006 Wilk, Jr. et al.
D523,123 S 6/2006 Wilk, Jr. et al.
7,127,752 B2 10/2006 Ball
7,300,074 B1 11/2007 Paulson
D586,433 S 2/2009 Price et al.
2001/0002494 A1 6/2001 Fritz et al.
2002/0032926 A1 * 3/2002 Lewis ..... 4/680
2002/0112285 A1 8/2002 Minnick
2003/0151281 A1 8/2003 Williams
2004/0068793 A1 4/2004 Ball
2004/0111797 A1 6/2004 Ball
2004/0117907 A1 6/2004 Ball
2007/0007763 A1 1/2007 Deaton
2008/0148477 A1 6/2008 Shafik
2009/0261579 A1 10/2009 Spears

OTHER PUBLICATIONS

Official Action for U.S. Appl. No. 10/732,726, mailed Apr. 15, 2010.
Notice of Allowability for U.S. Appl. No. 29/362,288, mailed Oct. 7, 2010.
"WCM Industries-Freezeless Faucets, Yard Hydrants and Bath Wastes", as early as Aug. 2000, available at http://www.woodfordmfg.com/, printed on Sep. 15, 2005, p. 1.
"New WATCO Eliminator Bath Waste", WATCO, as early as Aug. 8, 2001, pp. 1-2.
"Tubular Plastic-Innovator® 590", Woodford Manufacturing Company, first sold Aug. 16, 2001, pp. 1-2.
Office Action for U.S. Appl. No. 10/732,726, mailed May 19, 2006.
Office Action for U.S. Appl. No. 10/732,726, mailed Jan. 30, 2008.
Office Action for U.S. Appl. No. 10/732,726, mailed Jun. 2, 2008.
Office Action for U.S. Appl. No. 10/732,726, mailed Aug. 20, 2008.
Office Action for U.S. Appl. No. 10/732,726, mailed Nov. 17, 2008.
Office Action for U.S. Appl. No. 10/732,726, mailed Mar. 28, 2005.
Office Action for U.S. Appl. No. 10/732,726, mailed May 23, 2005.
Office Action for U.S. Appl. No. 10/732,726, mailed Oct. 24, 2005.
Office Action for U.S. Appl. No. 10/732,726, mailed Dec. 9, 2008.
Office Action for U.S. Appl. No. 10/732,726, mailed May 1, 2008.
Office Action for U.S. Appl. No. 10/674,862, mailed Mar. 28, 2005.
Office Action for U.S. Appl. No. 10/674,862, mailed Aug. 18, 2004.
Notice of Allowance for U.S. Appl. No. 10/674,862, mailed Aug. 24, 2006.
Office Action for U.S. Appl. No. 10/674,862, mailed Oct. 6, 2005.
Office Action for U.S. Appl. No. 10/674,862, mailed Sep. 20, 2005.
Official Communication for U.S. Appl. No. 10/674,862, mailed May 23, 2008.
Examiner's Answer for U.S. Appl. No. 10/674,862, mailed May 15, 2008.
Office Action for U.S. Appl. No. 10/674,862, mailed May 1, 2007.
Office Action for U.S. Appl. No. 10/674,862, mailed Dec. 21, 2006.
Notice of Allowance for U.S. Appl. No. 10/738,772, mailed Aug. 1, 2006.
Notice of Allowance for U.S. Appl. No. 10/738,772, mailed May 11, 2006.
Notice of Allowance for U.S. Appl. No. 10/738,772, mailed Mar. 27, 2006.
Notice of Allowance for U.S. Appl. No. 10/738,772, mailed Aug. 2, 2005.
Notice of Allowance for U.S. Appl. No. 10/738,772, mailed May 13, 2005.
Notice of Allowance for U.S. Appl. No. 10/738,772, mailed Mar. 11, 2005.
Notice of Allowance for U.S. Appl. No. 10/738,772, mailed Sep. 17, 2004.
Office Action for U.S. Appl. No. 10/738,765, mailed May 22, 2007.
Office Action for U.S. Appl. No. 10/738,765, mailed Jan. 13, 2006.
Office Action for U.S. Appl. No. 10/738,765, mailed Jun. 6, 2005.
Office Action for U.S. Appl. No. 10/738,765, mailed Apr. 13, 2006.
Official Action for U.S. Appl. No. 10/732,726, mailed May 9, 2011 9 pages.
Official Action for U.S. Appl. 10/732,726, mailed Oct. 25, 2010.
Official Action for U.S. Appl. No. 10/732,726, mailed Nov. 16, 2011 9 pages.

* cited by examiner

OVERFLOW ASSEMBLY FOR BATHTUBS AND THE LIKE

CROSS REFERENCE TO RELATED APPLICATIONS

This application is a continuation-in-part of U.S. patent application Ser. No. 10/674,862, filed Sep. 30, 2003 now abandoned, which is a continuation-in-part of U.S. patent application Ser. No. 10/222,062, filed Aug. 16, 2002, now U.S. Pat. No. 6,637,050, and a continuation-in-part of U.S. patent application Ser. No. 10/229,533, filed Aug. 28, 2002, now U.S. Pat. No. 6,675,406, which is a continuation of abandoned U.S. patent application Ser. No. 09/593,724, filed Jun 13, 2000. This application is also a continuation-in-part of pending U.S. patent application Ser. No. 10/732,726, filed Dec. 10, 2003, which is a continuation-in-part of U.S. patent application Ser. No. 10/229,533, filed Aug. 28, 2002, now U.S. Pat. No. 6,675,406, which is a continuation of abandoned U.S. patent application Ser. No. 09/593,724, filed Jun. 13, 2000, U.S. patent application Ser. No. 10/732,726 also being a continuation-in-part of U.S. patent application Ser. No. 09/954,420, filed Sep. 17, 2001, now U.S. Pat. No. 6,691,411. The entire disclosures of the above-referenced patents and applications are incorporated by reference herein.

BACKGROUND OF THE INVENTION

In new building construction, plumbers prefer not to install finished closure valves in the bottom of bathtubs, or install finished decorative plate over an overflow outlet of the bathtub until the project is finished because these elements will be often damaged during construction. Further, the plumbing for all outlets needs to be checked for leaks which involves filling a vent for the drain until the water level in the plumbing rises above the bathtub so that the inspector can determine whether any of the plumbing leaks. The bottom drain of the bathtub is plugged and some sort of seal plate is used to block the outlet port during testing.

Existing overflow plates have a center opening. There are either two or four small screw holes in the plate adjacent the center opening wherein two of the holes are used to secure the plate to the plumbing fixture. In some cases, a fitting is used so that the screw hole is located directly in the middle of the access hole that becomes an obstacle during testing. The testing procedure usually involves placing a balloon through the large center opening into a drain pipe located in the wall. The pipe is sealed when the balloon is inflated.

A more recent version of an overflow assembly is shown in the U.S. Pat. No. 5,890,241 to Ball ("Ball"), which is incorporated by reference herein. Ball discloses a flexible diaphragm that is imposed over an overflow drain pipe. A cap is also provided that allows fluid to flow into the overflow pipe. The diaphragm seals the overflow pipe when the system is being tested for leaks. Following the test, the diaphragm is cut or slashed to open the overflow port to allow fluid flow. While this device serves the intended function, it is expensive to make and cumbersome to assemble.

It is, therefore, a principal object of the invention to provide a method and a means for an overflow assembly for bathtubs and the like that will safeguard the overflow system during construction, prepare the overflow system for testing, and facilitate the final installation of bathtub hardware.

A further object of the invention is to facilitate the testing procedure of the overflow system before final installation has taken place, and to permit the assembly of parts without the use of screws, screw holes, and the like.

A still further object of the invention is to provide an overflow fitting that allows a user to install the overflow fitting without using solvent cement.

These and other objects will be apparent to those skilled in the art.

SUMMARY OF THE INVENTION

An overflow system of a bathtub generally includes an overflow port that is associated with a drain pipe. The overflow port includes a threaded flange with a stub shoulder on one end that is fitted onto a circular sleeve. The threaded flange has threads on its outer surface and a thin diaphragm secured to the end thereof opposite the stub shoulder. A large sealing washer cooperates with the outside of the circular flange on the overflow port and extends partially over the threads of the flange. A large internally threaded nut is threadably mounted on the outer end of the threaded flange and compresses the sealing washer against a vertical flange on the overflow port to seal the connection between the threaded flange and the overflow port. A decorative cap is frictionally engaged onto protrusions located on the outer surfaces of the nut. The cap can be removed if needed to permit a plumber to gain access to the diaphragm to cut it open for fluid flow after the plumbing system has been tested for leaks, or put in place after the cut takes place.

DETAILED DESCRIPTION

Figure 1:
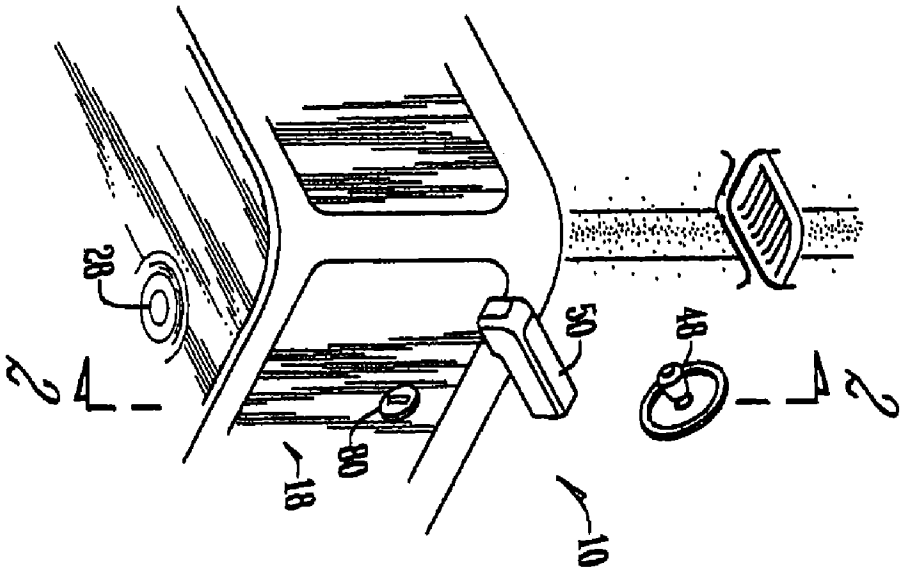
FIG. 1 is a partial perspective view of a conventional bathtub environment utilizing the invention of this application.
Figure 2:
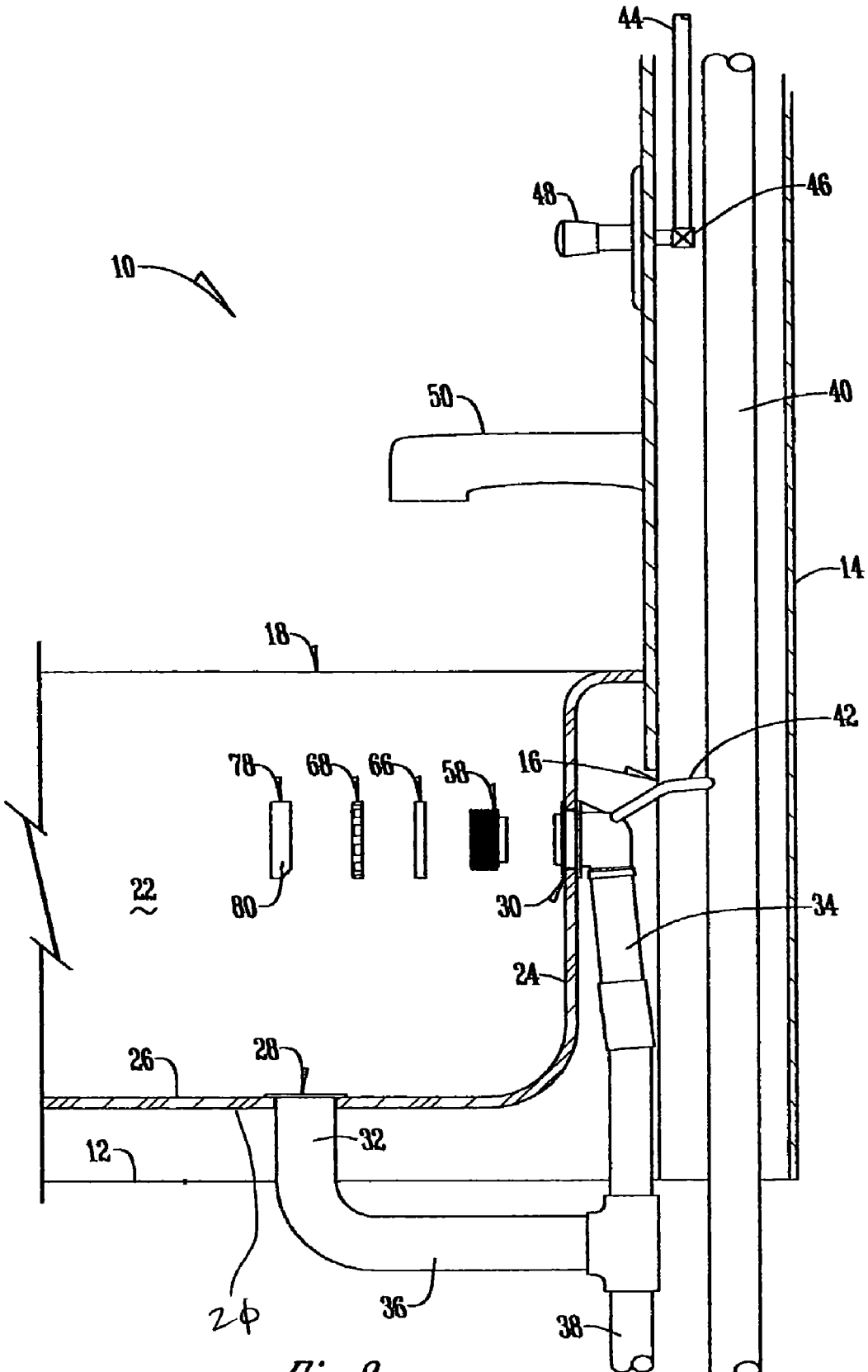
FIG. 2 is a section view taken on line 2-2 of FIG. 1.

With reference to FIGS. 1 and 2, a conventional bathroom structure 10 has a floor 12 and a hollow wall 14 with a wall opening 16 therein. A conventional bathtub ("tub") 18 has sidewalls that 22 extend upwardly from a base 20 as does an end wall 24. The end wall 24 extends upwardly from a bottom surface 26, perpendicular to the side walls 22.

A conventional drain port 28 is located in the bottom surface 26. A conventional overflow port 30 is located in the end wall 24 (FIG. 2). A vertical drain pipe 34 extends downwardly from drain port 28 and an overflow drain pipe 34 extends downwardly from overflow port 30. A horizontal pipe 36 connects pipes 32 and 34. A drain pipe 38 extends downwardly from the junction between pipes 34 and 36.

A conventional vent pipe 40 is located within the hollow wall 14. Pipe 42 interconnects the vent pipe 40 and the upper end of overflow drain pipe 34 (FIG. 2). Conventional water supply pipes 44 extend through hollow wall 14 and are connected to valve 46 which is interconnected to conventional control member 48 and faucet 50.

Figure 3:
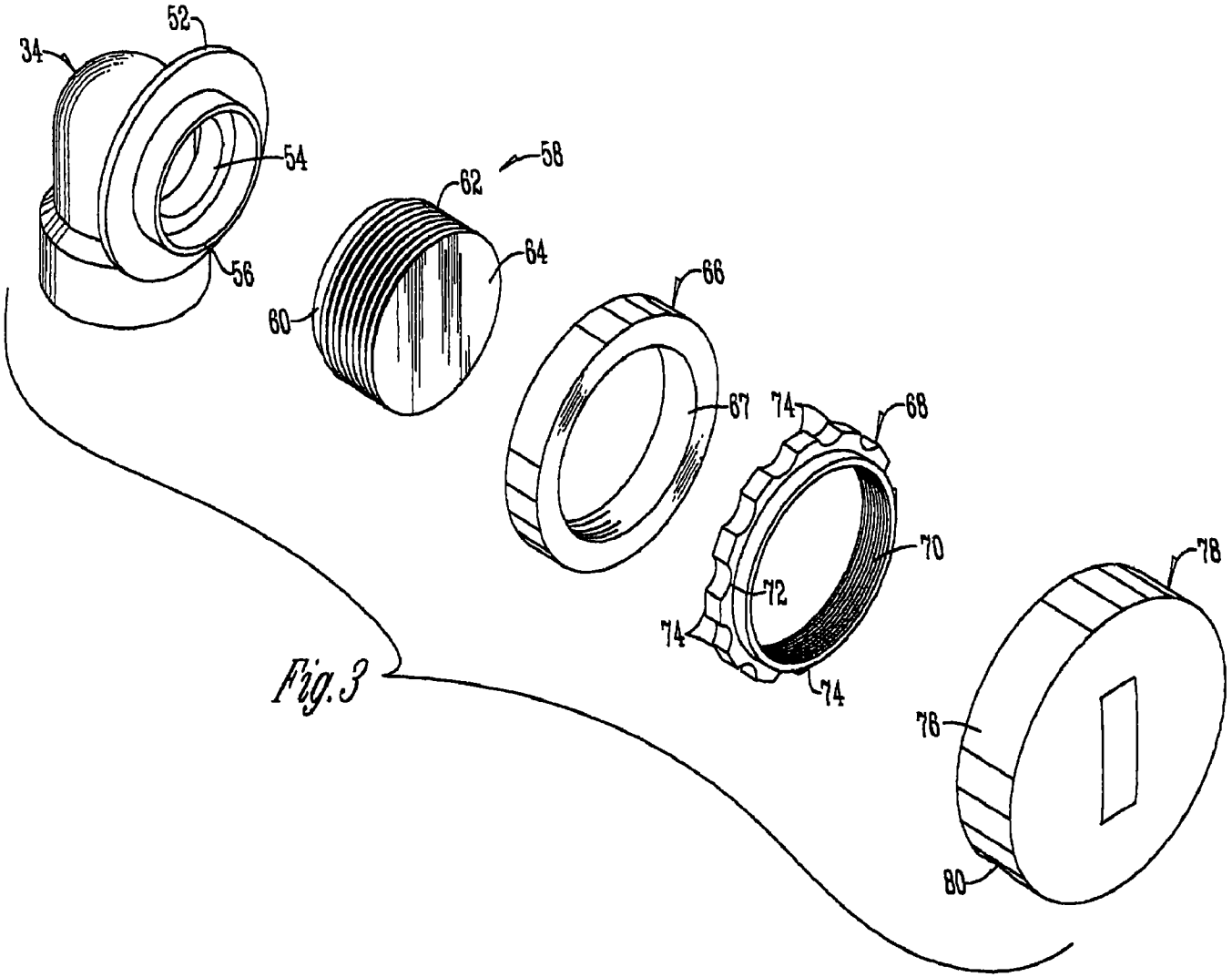
FIG. 3 is a perspective exploded view of an overflow assembly of one embodiment of the present invention.
Figure 4:
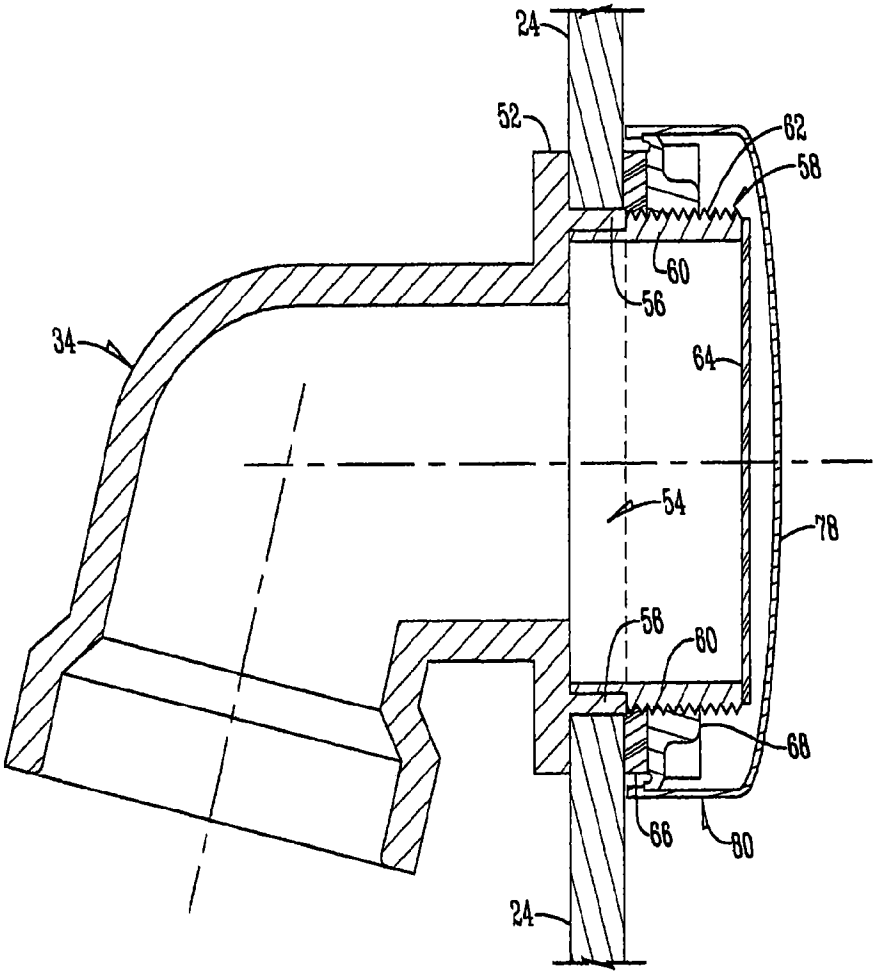
FIG. 4 is a cross sectional view of the assembled components of FIG. 3.

FIGS. 3 and 4 show a radial flange 52 formed on the upper end of overflow drain pipe 34 and has a center opening or port 54. Water can flow through center opening 54 into overflow drain pipe 34. A sleeve 56 extends longitudinally outwardly from the perimeter of opening 54 forming a surface on its inner diameter.

A hollow cylindrical fitting 58 has a hollow cylindrical shoulder 60 on its inner end, a threaded outer surface 62, and a thin plastic diaphragm 64 sealed across its outer end. The shoulder 60 has an outer diameter that can be manually frictionally inserted within the surface of the inner diameter of sleeve 56 to create sufficient frictional force to resist opposing force applied by fluid pressure.

A pliable sealing ring or washer 66 has a center bore 67 which frictionally receives the exterior surface of fitting 58 to engage the radial flange 52 of port 54 to seal the connection between sleeve 56 and shoulder 60. The longitudinal thickness of washer 66 is less than the longitudinal thickness of fitting 58 so that some of the threaded surface 62 adjacent the diaphragm 64 is exposed when the washer 66 is mounted on fitting 58 in the position described above. A nut element 68 has a threaded center bore 70 which is compatible with the threaded outer surface 62 of fitting 58. When the nut element 68 is tightened on threaded portion 62, the washer 66 is in tight engagement with flange 52 of port 54. The outer periphery 72 of nut element 68 has a series of radially extending lugs 74 which frictionally detachably engage the inner surface of flange 76 of cap 78. The nut element 68 can be tightened on washer 66 either as positioned within cap 78, or before cap 78 and the nut element 68 are engaged. A notch 80 is located in flange 76 and is adapted to receive overflow water from tub 18 when required to do so. Notch 80 is normally in a 6 o'clock position on flange 76. FIG. 4 depicts the apparatus described above in an assembled state.

It is important to note that diaphragm 64 is of plastic material, as is fitting 58, and is preferably integrally formed with fitting 58 wherein diaphragm 64 and fitting 58 are one unitary component. The diaphragm 64 is a thin circular plate disk that is joined to fitting 58 by its outer peripheral edge engaging the outer peripheral edge of the fitting 58. If the two components are not molded as one unitary structure, the diaphragm 64 could be connected by fusing, hermetically sealing, or by otherwise rigidly attaching by its outer peripheral edge to the rearward outer peripheral edges of the fitting 58 by a suitable adhesive. No screws or the like are either required or desired.

Figure 6:
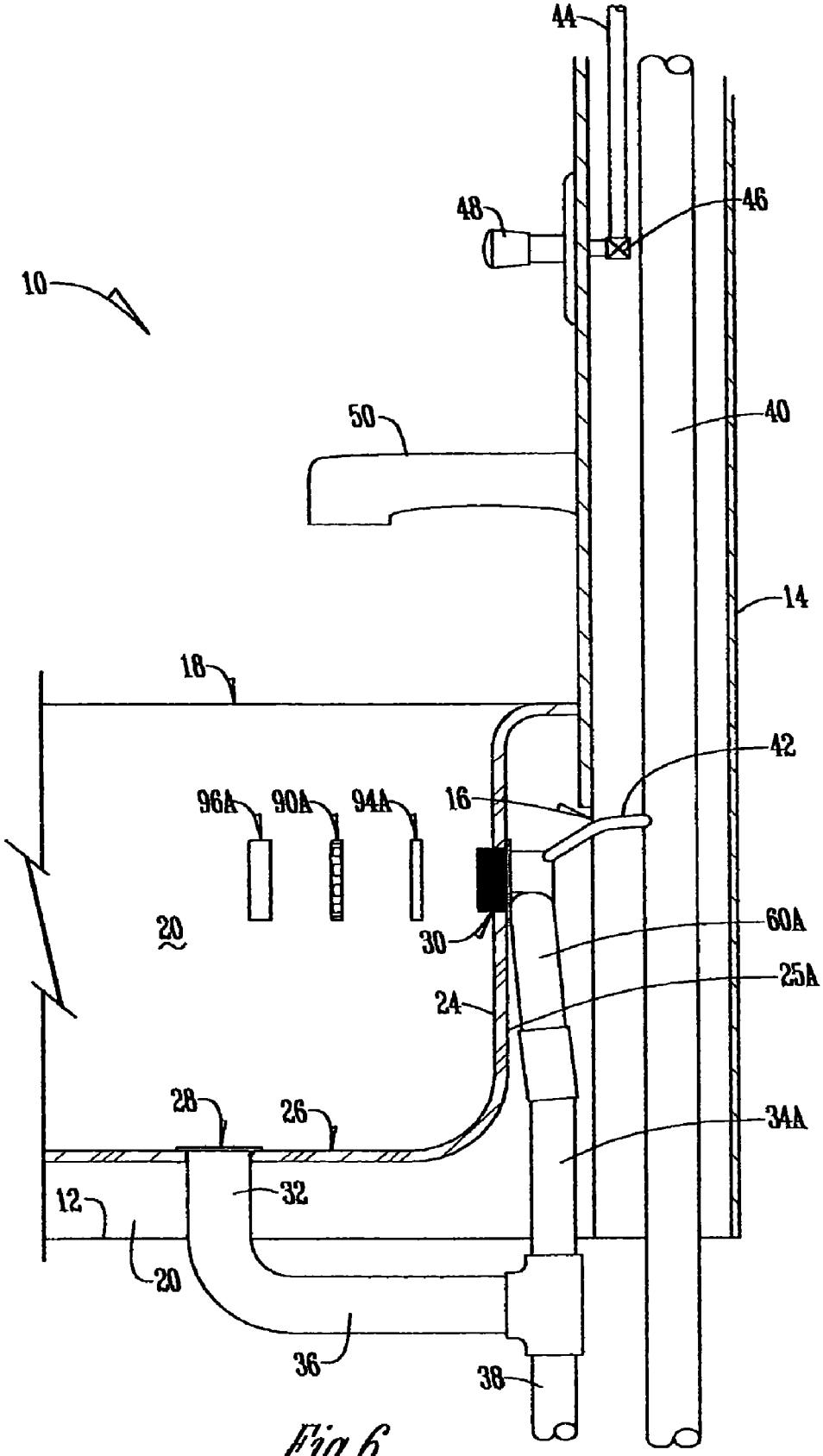
FIG. 6 is a sectional view of a conventional bathtub environment utilizing the device of another embodiment of the invention.

A second embodiment of the invention can be seen in FIG. 6. A one-piece overflow fitting 60A is shown attached to second vertical drain pipe 34A. A portion of the overflow fitting 60A passes through overflow port 30.

Figure 8:
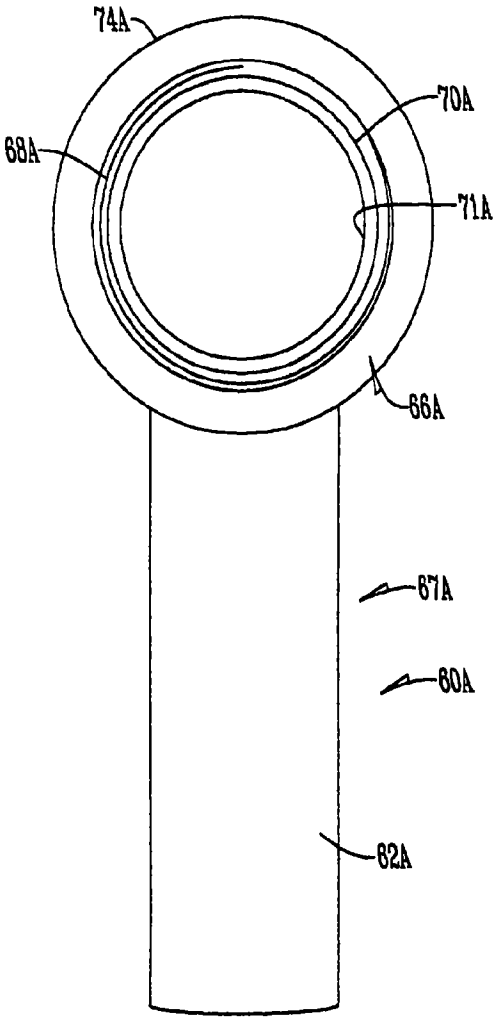
FIG. 8 is a front view of the device of the embodiment of the invention shown in FIG. 6.
Figure 7:
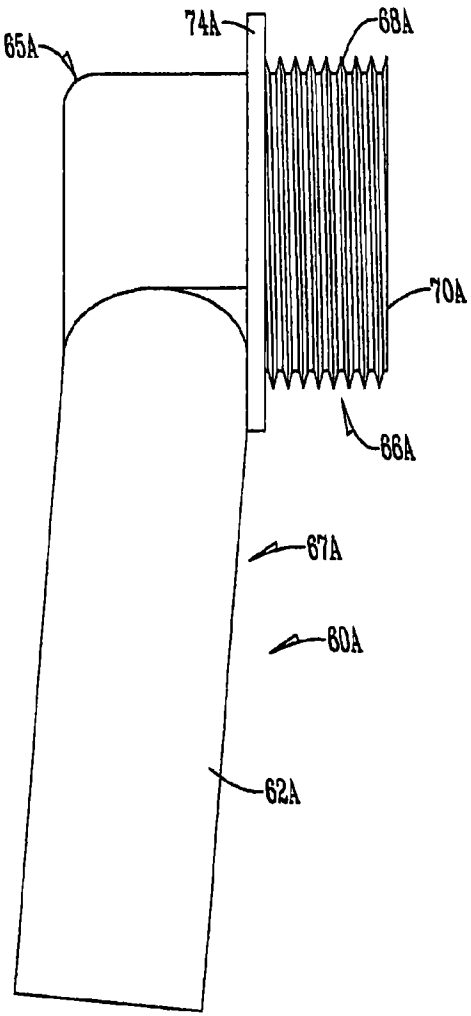
FIG. 7 is a side view of the device of the embodiment of the invention shown in FIG. 6.
Figure 9:
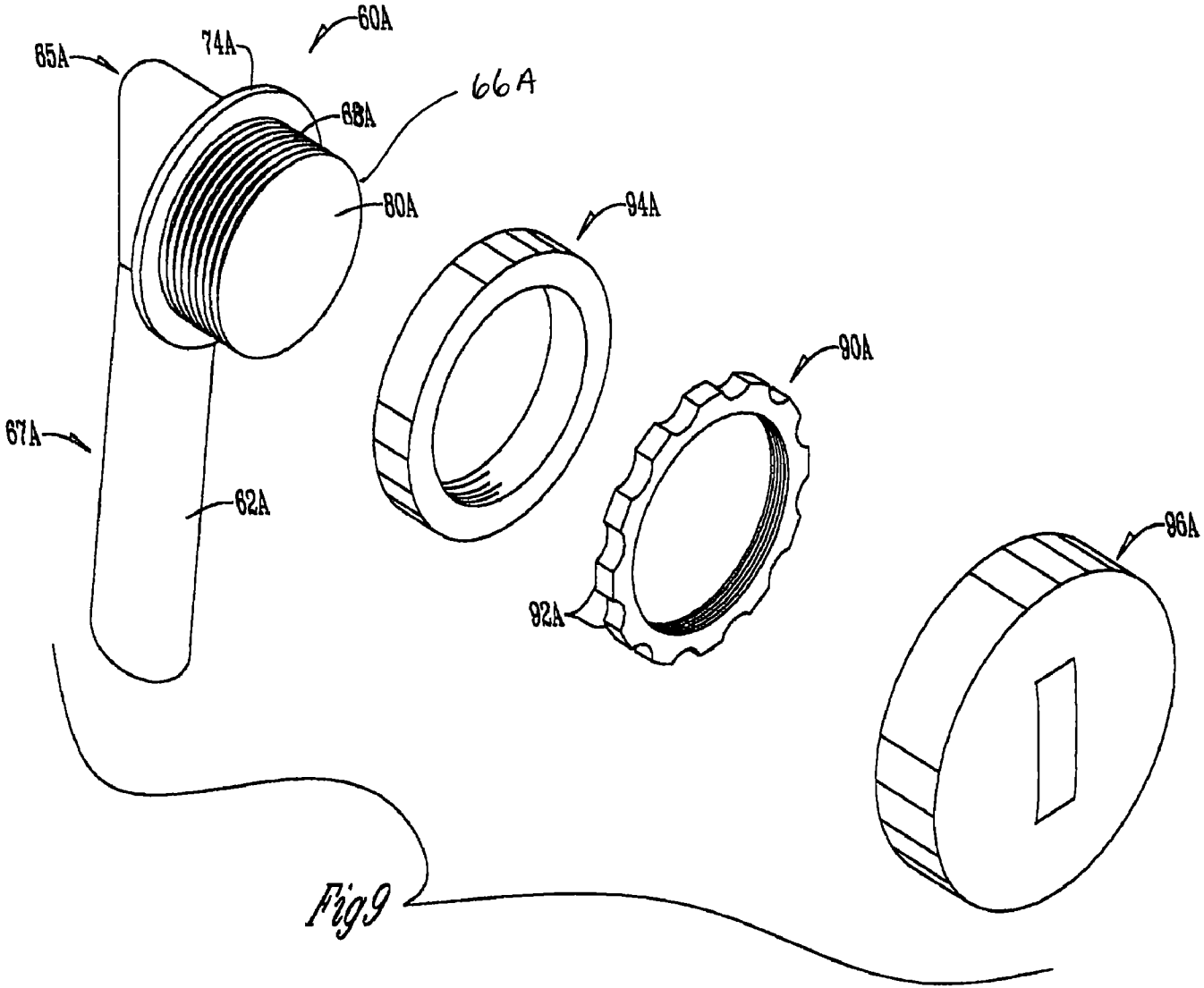
FIG. 9 is an exploded perspective view of the device of the embodiment of the invention shown in FIG. 6.

With reference to FIGS. 7-9, the overflow fitting 60A is shown that has an overflow pipe 62A with an inverted L-shape. The overflow pipe 62A has an elbow portion 65A which defines an upper end portion 66A and a lower end portion 67A. It will be understood that the overflow pipe 62A may be made of copper, plastic, or any other suitable material.

The upper end portion 66A has threads 68A on its outer surface and also has an outer end 70A. The outer end 70A defines an inlet 71A to the upper end portion 66A of the overflow pipe 62A. The inlet 71A is adapted to fit through the bathtub overflow port.

The overflow fitting 60A also has a lip 74A extending radially outwardly from an outer surface of the overflow pipe 62A between the elbow portion 65A and the upper end portion 66A. The lip 74A is spaced from the inlet 71A to engage an outer surface of the bathtub end wall 24 around the bathtub overflow port 30, thereby allowing only the upper end portion 66A to pass through the overflow port 30.

A thin diaphragm 80A is sealed to the outer end 70A of the end portion 66A. The diaphragm 80A is a circular membrane and has a diameter that is not less than the diameter of the outer end 70A of the overflow pipe 62A. In one embodiment, the diaphragm 80A is integral with the outer end 70A and is held to the outer end 70A only through having been integrally formed therewith. The diaphragm 80A may be hermetically sealed to the outer end 70A. The diaphragm 80A may be composed of plastic material, flexible rubber, or the like. The diaphragm 80A is composed of a material that is easily punctured or easily removable.

The overflow fitting 60A further includes a nut element 90A having threads compatible with the threads 68A on the upper end portion 66A of the overflow pipe 62A. The nut element 90A removably secures the overflow pipe 62A to the bathtub 20 by compressing the end wall 24 between the nut element 90A and the lip 74A. The nut element 90A may be a slip nut.

As shown in FIG. 9, the nut element 90A has a series of radially extending lugs 92A along the nut element 90A outer periphery. These lugs 92A detachably engage the inner surface of a cap 96A. The cap 96A serves to cover the overflow fitting 60A hardware.

During installation of the overflow fitting 60A, a washer 94A may be placed between the upper end portion 66A of the overflow pipe 62A and the nut element 90A. The washer 94A seals the overflow fitting 60A to the tub 18.

In operation, the drainage system comprising the ports 28 and 30, and pipes 34, 36, and 38 are installed as shown in FIG. 2. The vent pipe 40 and connecting pipe 42 are also installed.

Figure 5:
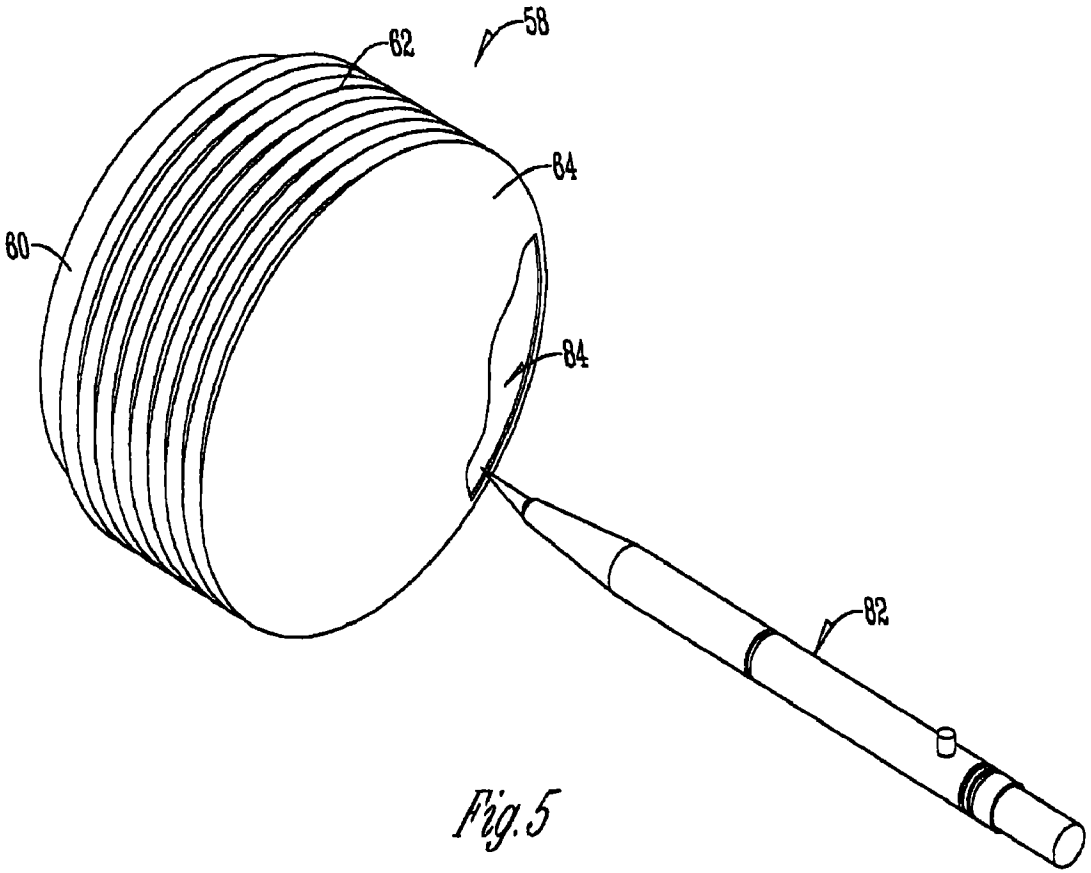
FIG. 5 is a perspective view showing a pierced diaphragm.

In the conventional testing procedure, the port 28 is plugged in any convenient manner. The fitting 58 with diaphragm 64 is installed into drain pipe 34 as described above so there is no fluid access to the upper end of pipe 34 either inwardly or outwardly through overflow port 30. The vent pipe 40 is charged with water at some elevation above connecting pipe 42 so that the building inspectors can check to see if there are any leaks in the system. Having determined that there are no leaks, the water is purged from the system. The plumber can then approach overflow port 30, (because cap 78 is not yet installed) and by using knife 82 or the like, cuts can be made in diaphragm 64 leaving a cutout portion 84 as shown in FIG. 5.

Similarly, in operation the overflow fitting 60A is attached to the second vertical drain pipe 34A already plugged by the diaphragm 80A as described above, so there is no fluid access to the upper end of second vertical drain pipe 34A either inwardly or outwardly out of the overflow port 30. The vertical vent pipe 40 is charged with water at some elevation above connecting pipe 42 so that it can be determined if there are any leaks in the system.

Figure 10:
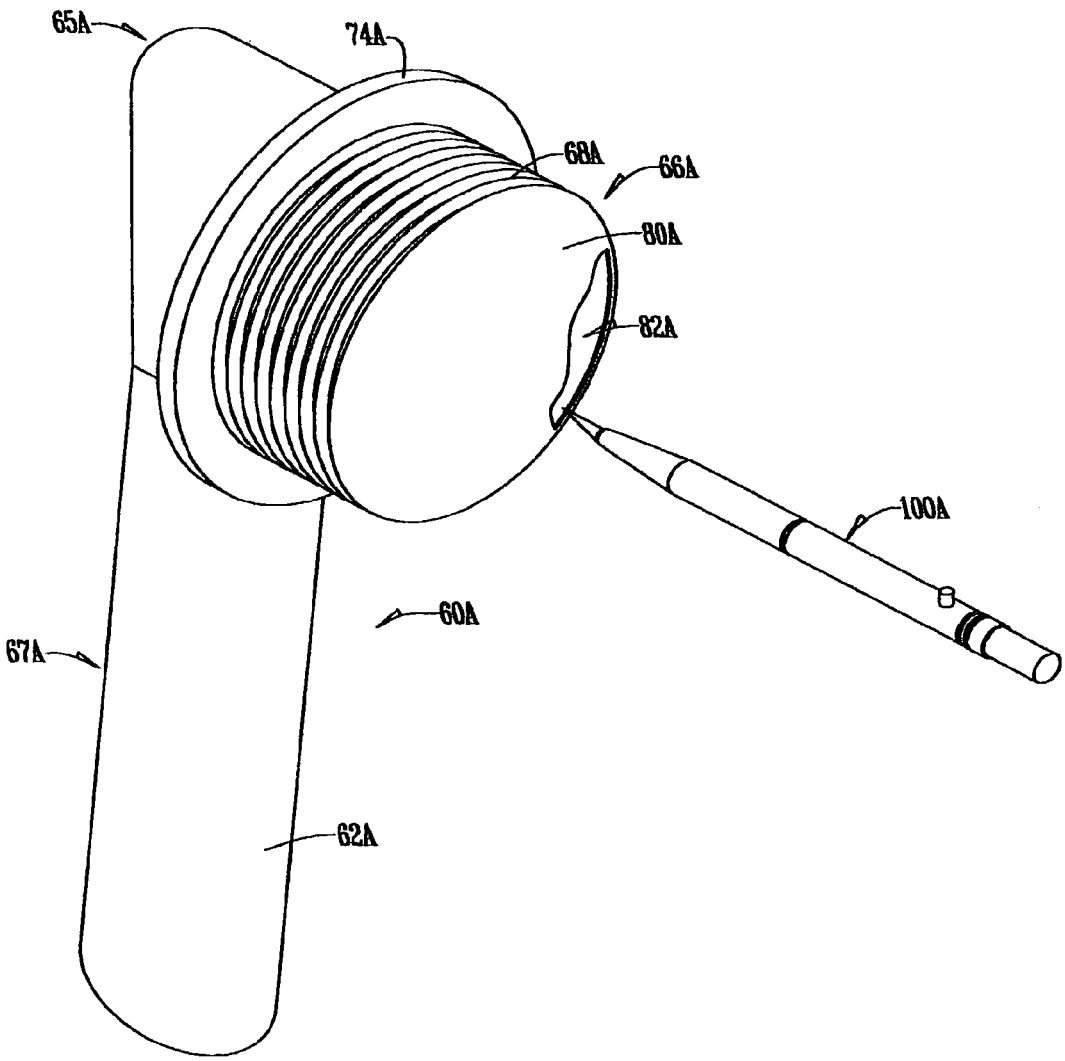
FIG. 10 is a perspective view of the installation of the embodiment of the invention shown in FIG. 6.

With reference to FIG. 10, having determined that there are no leaks, the water is purged from the system. The plumber can then approach overflow port 30, and by using a cutting device 100A, such as a knife of any other sharp object, cuts 82A can be made in the diaphragm 80A. This can be quickly and easily done without disassembling any of the structure of overflow fitting 60A. Any valve linkage elements required may be installed through cuts 82A, and any cap (such as cap 96A shown in FIG. 9) or cover for the overflow port 30 may be placed over the overflow pipe 62A upper end portion 66A.

Figure 11:
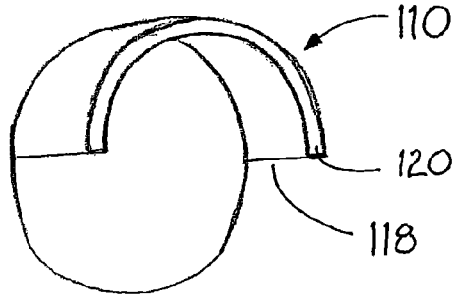
FIG. 11 is a perspective view of an overflow plate according to one embodiment of the present invention.
Figure 12:
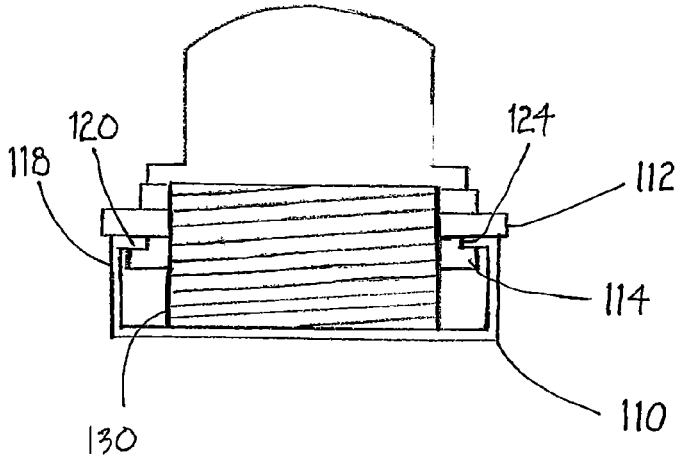
FIG. 12 is a sectional top view of the assembly according to one embodiment of the present invention.

Referring now to FIGS. 11 and 12, an alternate embodiment of the invention is shown wherein an overflow plate 110 is modified to slide vertically into position between the surface of the tub 112 and the retainer nut 114. The overflow plate 110 has a first section, which comprises a rim 118 and a lip 120 extending inwardly therefrom, and a second section, which does not comprise a rim or a lip, thereby forming a recessed portion. The modified overflow plate 110 engages a notched surface 124 on at least a portion of the retainer nut 114 as shown in FIG. 12. The notch 124 may be incorporated along the entire circumference of the nut 114 as well. The overflow plate 110 according to this embodiment slides along an outward facing surface of the overflow plate 130 and engages the retainer nut 114 along the notched surface 124. The notched surface 124 is located along a lateral face of the retainer nut 114. The thickness of the lip 120 and the width of the notched surface 124 are such that the overflow plate 110 forms a near perfect fit once it engages the notched surface 124, thereby firmly holding the overflow plate 110 in place between the retainer nut 114 and the surface of the tub 112.

Figure 13:
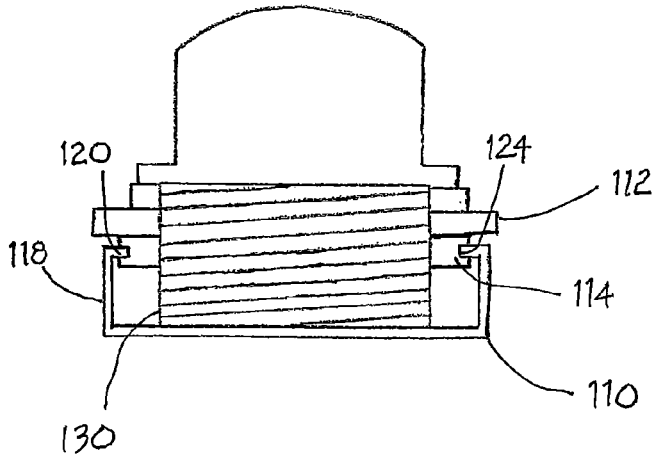
FIG. 13 is a sectional top view of the assembly according to another embodiment of the present invention.

As shown in FIG. 13, the notched surface 124 of the retainer nut 114 may be located nearly concentrically about the thickness of the retainer nut 114. According to this embodiment, the overflow plate 110 may be engaged with the centrally located notched surface 124 of the retainer nut 114, by sliding the overflow plate 110 in a downward direction to engage the lip 120 of the overflow plate 110. According to this embodiment, the overflow plate 110 is held in place by engaging both sides of the retainer nut 114 surrounding the notched surface 124, thereby holding the overflow plate 110 firmly in place over the overflow port 130.

Figure 14A:
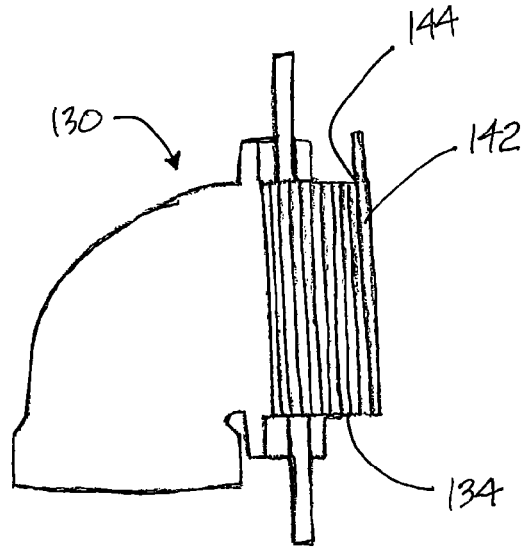
FIG. 14*a* is a sectional side view of the assembly according to yet another embodiment of the present invention.
Figure 14B:
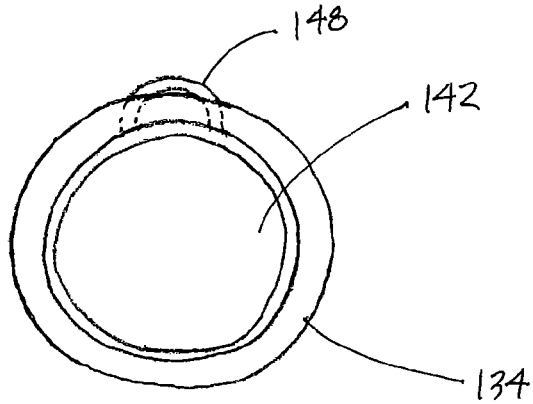
FIG. 14*b* is a partial front view of the assembly of FIG. 14*a*.
Figure 15:
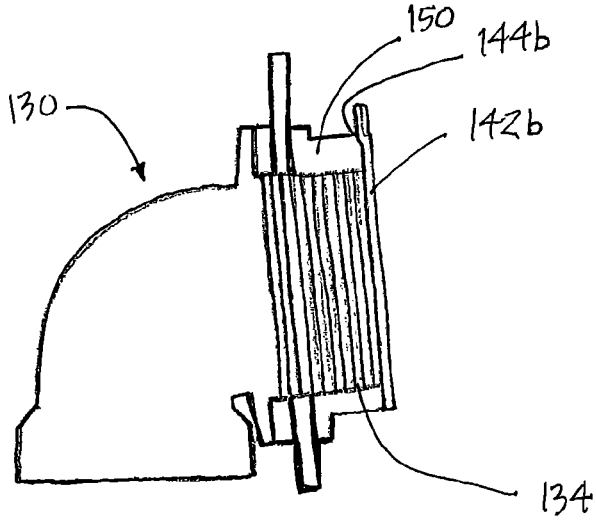
FIG. 15 is a sectional side view of the assembly according to yet another embodiment of the present invention.

Further alternative embodiments are shown in FIGS. 14*a*, 14*b* and 15, that show a removable seal 142 that may be selectively inserted or removed from the overflow assembly to prevent or permit water to flow through the overflow assembly 130. The removable seal 142, according to this embodiment, is such that it may be inserted into a slot 144 formed in the threaded portion 134 of the overflow assembly 130, thereby sealing the overflow valve 130, or removed from the slot 144, thereby exposing the overflow port 130 without requiring a knife or other tool to cut out the seal 142 and potentially requiring the plumber to replace the seal 142 at a later time.

Referring now in detail to FIGS. 14*a* and 14*b*, according to one embodiment the seal 142 is inserted into a slot 144 formed within the threaded portion 134 of the overflow valve 130, such that the seal 142 resides in a vertical plane within the threaded portion 134 of the overflow assembly 130. The diameter seal 142 is substantially congruent with the diameter of the threaded portion 134 of the threaded portion 134 overflow valve 130, as best shown in FIG. 14*b*. The seal 142 may have a pull ring 148, which extends outside the slot 144 formed in the threaded portion 134 of the overflow assembly 130 so that the plumber may readily grasp the pull ring 148 and remove the seal 142 from the slot 144 in the threaded portion 134 of the overflow valve.

In yet another embodiment, the seal 142*b* is formed in a slot 144*b* that is formed in the retainer nut 150, which may be modified to extend outwardly from the outer most surface of the threaded portion 134 overflow assembly 130, as shown in FIG. 15. The seal 142*b* according to this embodiment operates in the same fashion is that described in relation between FIGS. 14*a* and 14*b*, in that the seal 142*b* may be removed or inserted at the discretion of the user.

It is therefore seen from the description above and accompanying drawing figures that this invention eliminates any need to seal the overflow pipe 34, 60A even after the overflow pipe 60A has been attached to the second vertical drain pipe 34A. The invention also eliminates any need to remove sealing components from the overflow port 30 after the testing procedure has taken place. In addition, the invention allows a user to install an overflow fitting 58, 62A without using solvent cement. This invention also facilitates the testing procedure and reduces the time needed to seal the overflow port 30, and then to open the diaphragm 64, 80A for possible fluid flow.

It is therefore seen this invention will achieve at least all of its stated objectives.

What is claimed is:

1. An overflow assembly for a bathtub, which has a bottom and adjacent side and end walls, and an overflow port in an end wall, comprising:

an overflow pipe with an elbow portion defining an upper end portion and a lower end portion, the upper end portion having an outer end defining an inlet;

threads on an outer surface of the upper end portion and surrounding the inlet;

a lip extending radially outwardly from an outer surface of the overflow pipe between the elbow portion and the upper end portion and being spaced from the inlet;

a sealing element associated with said outer end that closes the inlet to fluid flow;

a nut element compatible with the threads wherein the nut element has a threaded portion for threadably mounting to said upper end portion, said nut element having at least one lug extending radially therefrom; and a cap detachably associated to the lug and covering the nut.

2. The assembly of claim 1, wherein the overflow pipe and sealing element is of one-piece construction.

3. The assembly of claim 1, wherein said overflow pipe has an inverted L-shape.

4. The assembly of claim 1, further including a washer that cooperates with said nut and said lip to interconnect to said overflow pipe to the bathtub.

5. The assembly of claim 1, wherein said sealing element is a diaphragm that is adapted to be selectively cut to provide a flow path through said overflow pipe.

6. The assembly of claim 1, wherein said sealing element is an overflow plate that is selectively interconnected to said nut.

7. The assembly of claim 6, wherein said nut includes a notch that receives a lip of said overflow plate.

8. The assembly of claim 1, wherein said sealing element is a diaphragm with a pull ring.

9. The assembly of claim 8, wherein said diaphragm is slidingly interconnected to said overflow pipe.

10. The assembly of claim 8, wherein said diaphragm is pealably interconnected to said overflow pipe.

* * * * *